US007922312B2

(12) United States Patent
Haines et al.

(10) Patent No.: US 7,922,312 B2
(45) Date of Patent: Apr. 12, 2011

(54) COMPACT INK DELIVERY IN AN INK PEN

(75) Inventors: Paul Mark Haines, Corvallis, OR (US); Mark A. Devries, Corvallis, OR (US); Ronald J. Ender, Corvallis, OR (US); Craig L. Malik, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1022 days.

(21) Appl. No.: 11/739,293

(22) Filed: Apr. 24, 2007

(65) Prior Publication Data

US 2008/0266370 A1 Oct. 30, 2008

(51) Int. Cl.
*B41J 2/175* (2006.01)

(52) U.S. Cl. ..... 347/93; 347/91; 347/92; 347/94; 347/95

(58) Field of Classification Search ..... 347/91–95
See application file for complete search history.

(56) References Cited

U.S. PATENT DOCUMENTS

| | | | | |
|---|---|---|---|---|
| 3,786,517 | A * | 1/1974 | Krause | 347/74 |
| 4,403,227 | A | 9/1983 | Bertschy | |
| 5,546,109 | A | 8/1996 | Nakano | |
| 5,777,647 | A * | 7/1998 | Pawlowski et al. | 347/86 |
| 6,234,622 | B1 * | 5/2001 | Liu et al. | 347/93 |
| 7,188,942 | B2 * | 3/2007 | Haines et al. | 347/93 |
| 7,614,733 | B2 * | 11/2009 | Haines et al. | 347/93 |
| 7,661,803 | B2 * | 2/2010 | Morgan et al. | 347/85 |
| 2002/0158950 | A1 | 10/2002 | Altendorf | |
| 2003/0122907 | A1 | 7/2003 | Kim | |
| 2005/0030358 | A1 | 2/2005 | Haines | |

FOREIGN PATENT DOCUMENTS

| | | | |
|---|---|---|---|
| EP | 1258360 | A1 | 11/2002 |
| EP | 1106362 | A2 | 6/2006 |
| JP | 07096609 | | 4/1995 |
| JP | 2006122814 | | 5/2006 |
| JP | 2006198845 | | 8/2006 |

OTHER PUBLICATIONS

Supplementary European Search Report dated Apr. 27, 2010, Application No. EP 08 746 557.1.

Please see attached European Search Report for Application No. PCT/US2008/061161, filed on Apr. 22, 2008.

* cited by examiner

*Primary Examiner* — Ryan Lepisto
*Assistant Examiner* — Guy G Anderson

(57) ABSTRACT

In one embodiment an ink pen for an inkjet printer includes: an ink filter chamber; a pressure regulator chamber downstream from the ink filter chamber along a path of ink flow through the pen; a pressure regulator in the pressure regulator chamber; a filter in the ink filter chamber; an inlet to the ink filter chamber upstream from the filter along the ink flow path; and an outlet from the ink filter chamber to the pressure regulator chamber downstream from the filter along the ink flow path such that ink flowing from the inlet to the outlet passes through the filter. In another embodiment a method implemented in an ink delivery system for an inkjet ink pen includes: chambering ink in the pen; filtering the chambered ink; and then regulating the pressure of filtered ink.

19 Claims, 6 Drawing Sheets

COMPACT INK DELIVERY IN AN INK PEN

BACKGROUND

The physical size of an inkjet printer ink pen directly affects the size and cost of the printer. (An ink pen is also commonly referred to as an ink cartridge or an inkjet printhead assembly.) The bigger, higher performance inkjet pens used in some high end office printers require extensive structure and actuators to properly position the pens in the printer, enlarging both the size and the cost of the printer. The ink filtering and pressure regulating components in the ink delivery system in higher performance ink pens are some of the bulkiest components in the pen. These components are embedded in the body of the pen and, therefore, contribute to a large part of the pen size. By reducing the size of the ink filtering or the pressure regulating components, or both, the size of the pen may be significantly reduced.

DRAWINGS

DESCRIPTION

Embodiments of the present invention were developed in an effort to reduce the size of a higher performance, "off axis" inkjet ink pen. Exemplary embodiments of the invention will be described, therefore, with reference to an off axis ink pen and an inkjet printer. Embodiments of the invention, however, are not limited to the exemplary ink pen or printer shown and described below. Other forms, details, and embodiments may be made and implemented. Hence, the following description should not be construed to limit the scope of the invention, which is defined in the claims that follow the description.

Figure 1:
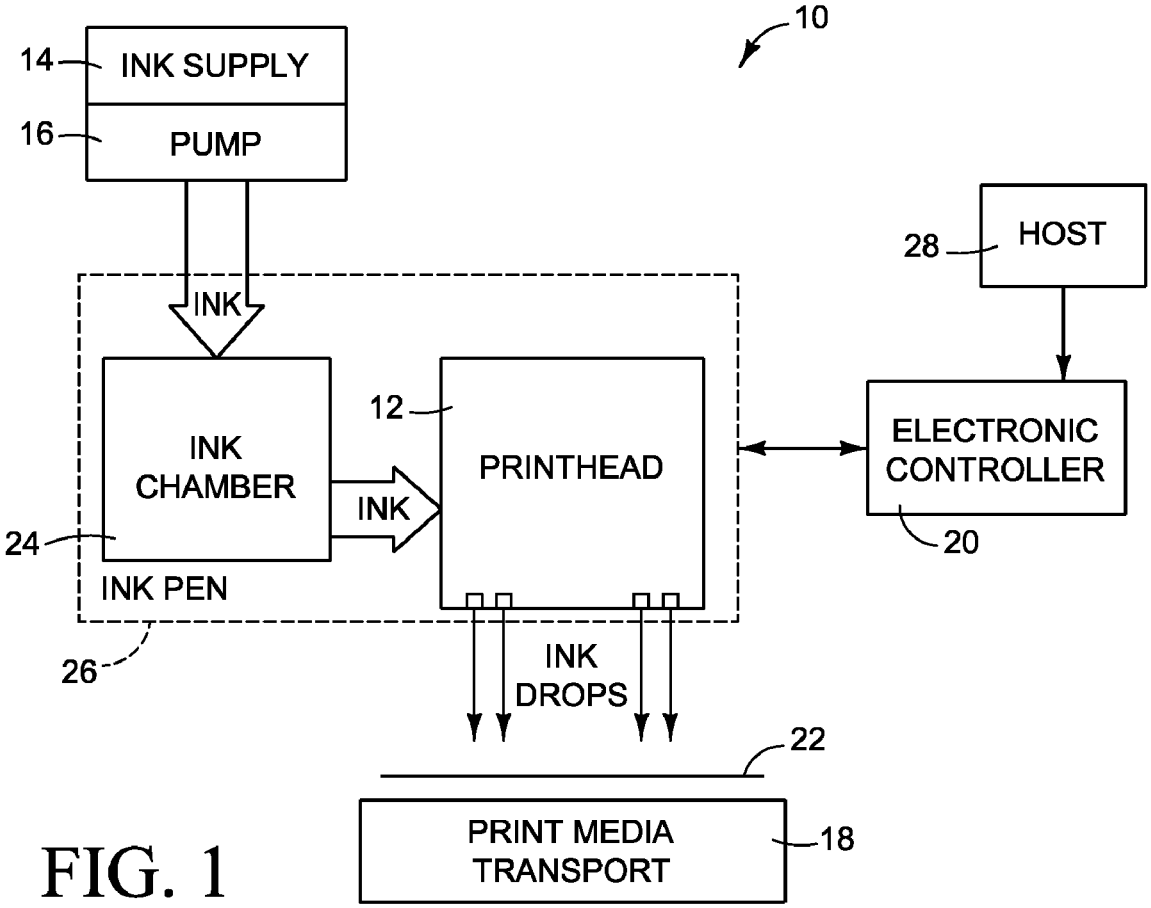
FIG. 1 is a block diagram illustrating an inkjet printer.

Referring to FIG. 1, inkjet printer 10 includes a printhead 12, an ink supply 14, a pump 16, a print media transport mechanism 18 and an electronic printer controller 20. Printhead 12 in FIG. 1 represents generally one or more printheads and the associated mechanical and electrical components for ejecting drops of ink on to a sheet or strip of print media 22. A typical thermal inkjet printhead includes a nozzle plate arrayed with ink ejection nozzles and firing resistors formed on an integrated circuit chip positioned behind the ink ejection nozzles. The ink ejection nozzles are usually arrayed in columns along the nozzle plate. Each printhead is operatively connected to printer controller 20 and ink supply 14. In operation, printer controller 20 selectively energizes the firing resistors and, when a firing resistor is energized, a vapor bubble forms in the ink vaporization chamber, ejecting a drop of ink through a nozzle on to the print media 22. In a piezoelectric printhead, piezoelectric elements instead of firing resistors are used to eject ink from a nozzle. Piezoelectric elements located close to the nozzles are caused to deform very rapidly to eject ink through the nozzles.

An ink chamber 24 and printhead 12 are often housed together in an ink pen 26, as indicated by the dashed line in FIG. 1. Ink flows to printhead 12 from ink supply 14 through ink chamber 24. Ink pens like ink pen 26, which allow the ink to be replaced as it is consumed from a remote, refillable, ink supply 14, are sometimes referred to as "off axis" pens. Ink chamber 24 represents generally one or more ink chambers 24 in pen 26 through which ink passes on its way to printhead 12. For example, as described below, the ink may pass through a filter chamber and a pressure regulating chamber before reaching the printhead. Printer 10 may include a series of stationary ink pens 26 that span the width of print media 22. Alternatively, printer 10 may include one or more ink pens 26 that are scanned back and forth across the width of media 22 on a moveable carriage. Media transport 18 advances print media 22 lengthwise past printhead 12. For stationary pens 26, media transport 18 may advance media 22 continuously past printhead 12. For a scanning pen 26, media transport 18 may advance media 22 incrementally past pen 26, stopping as each swath is printed and then advancing media 22 for printing the next swath.

Controller 20 receives print data from a computer or other host device 28 and processes that data into printer control information and image data. Controller 20 controls the movement of carriage, if any, and media transport 18. As noted above, controller 20 is electrically connected to printhead 12 to energize the firing resistors to eject ink drops on to media 22. By coordinating the relative position of pen(s) 26 and media 22 with the ejection of ink drops, controller 20 produces the desired image on media 22 according to the print data received from host device 28.

Figure 2:
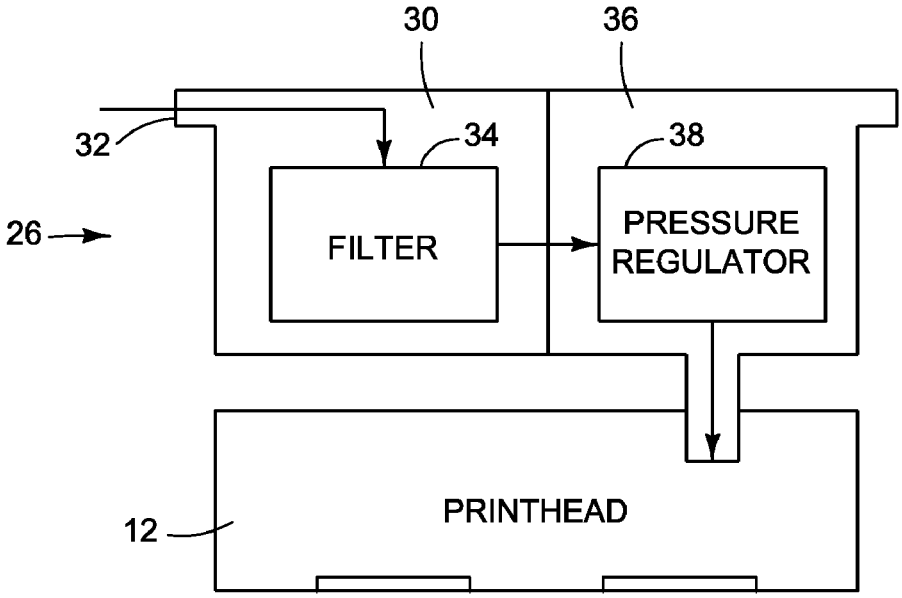
FIG. 2 is a block diagram illustrating one exemplary embodiment of an ink pen.

FIG. 2 is a block diagram illustrating one exemplary embodiment of an ink pen 26. Referring to FIG. 2, ink is pumped into a filter chamber 30 in pen 26 from a separate ink supply (not shown) through an inlet 32. Ink passes through a filter 34 in filter chamber 30 before flowing into a regulator chamber 36. (Ink chamber 24 from FIG. 1, for example, may include a filter chamber 30 and a regulator chamber 36 from the embodiment of ink pen 26 shown in FIG. 2.) Ink flows from regulator chamber 36 to printhead 12 where it may be ejected on to print media as described above. In many inkjet printers, ink flows to the printhead at a slight negative pressure (vacuum) to control the free flow of ink through the ink ejection nozzles when the printhead is not activated. Without such negative pressure, ink may leak or "drool" from the nozzles. Hence, a pressure regulator 38 in chamber 36 maintains the pressure in chamber 36 within a desired range of negative pressures. A variety of different types of pressure regulators, well known to those skilled in the art of off axis inkjet printing, may be adapted for use in pen 26. Pressure regulator 38, therefore, represents generally any suitable pressure regulator. For example, the spring bag type pressure regulator used in the ink pens for the Edgeline Technology printing products marketed by Hewlett-Packard Company may be adapted for use as pressure regulator 38 in pen 26.

Figure 3:
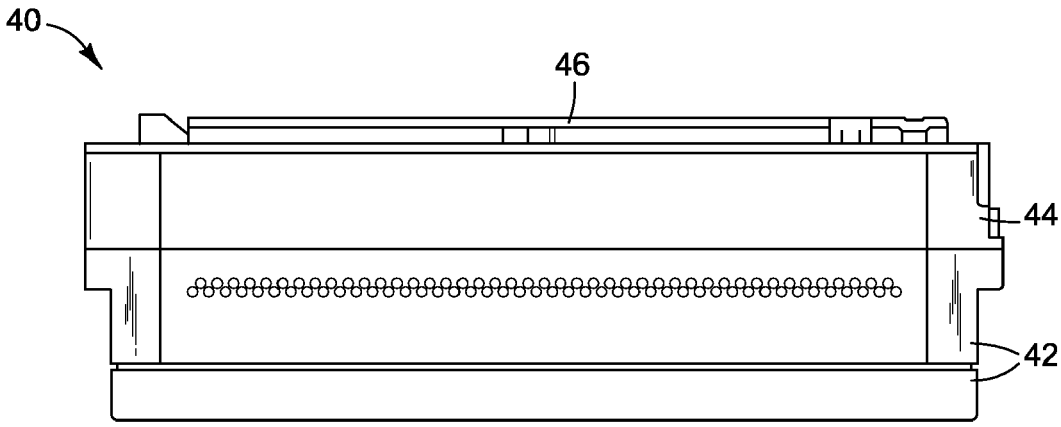
FIG. 3 is an elevation view of one exemplary embodiment of an ink pen.
Figure 4:
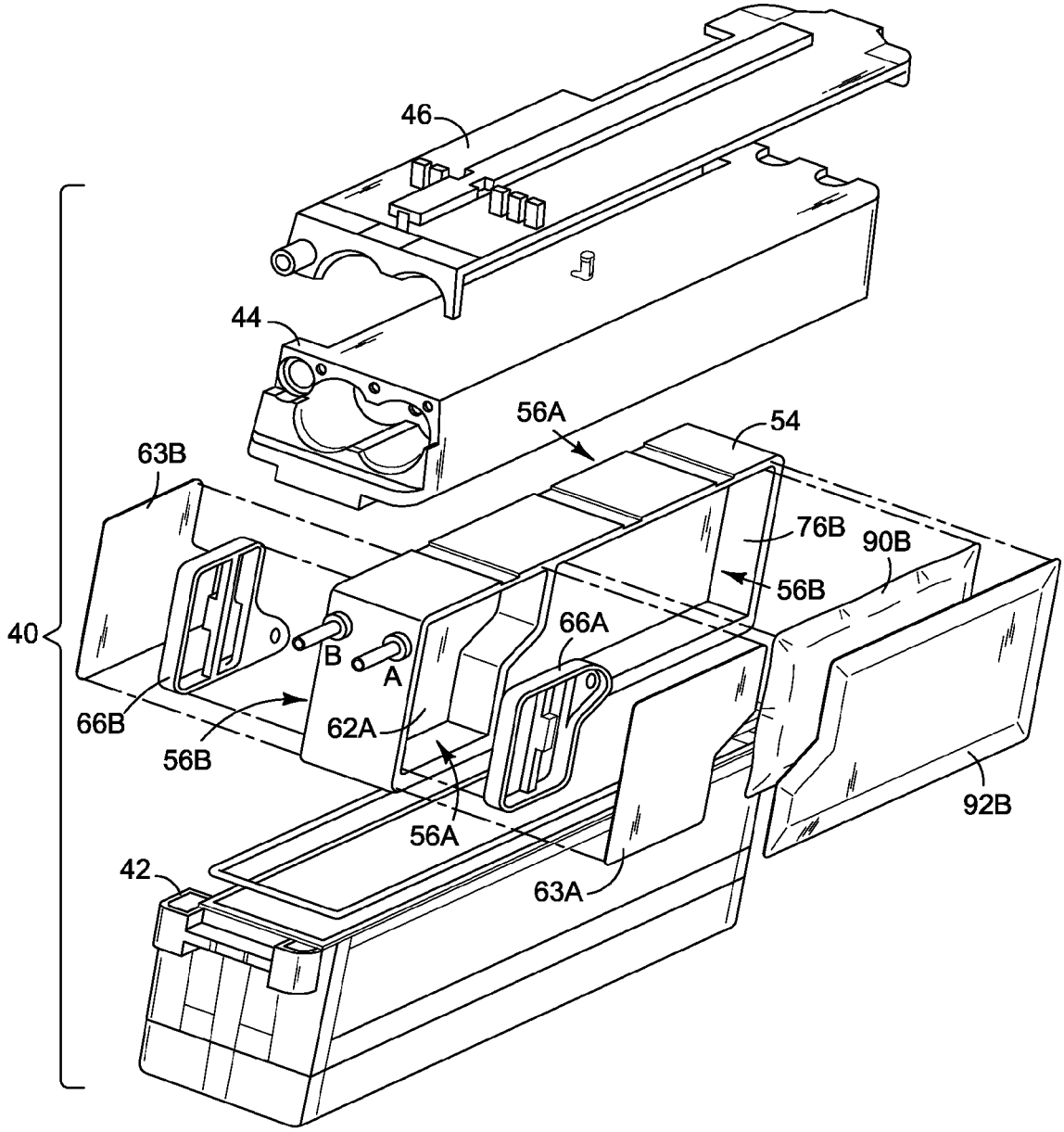
FIG. 4 is an exploded perspective view of the ink pen shown in FIG. 3.
Figure 5:
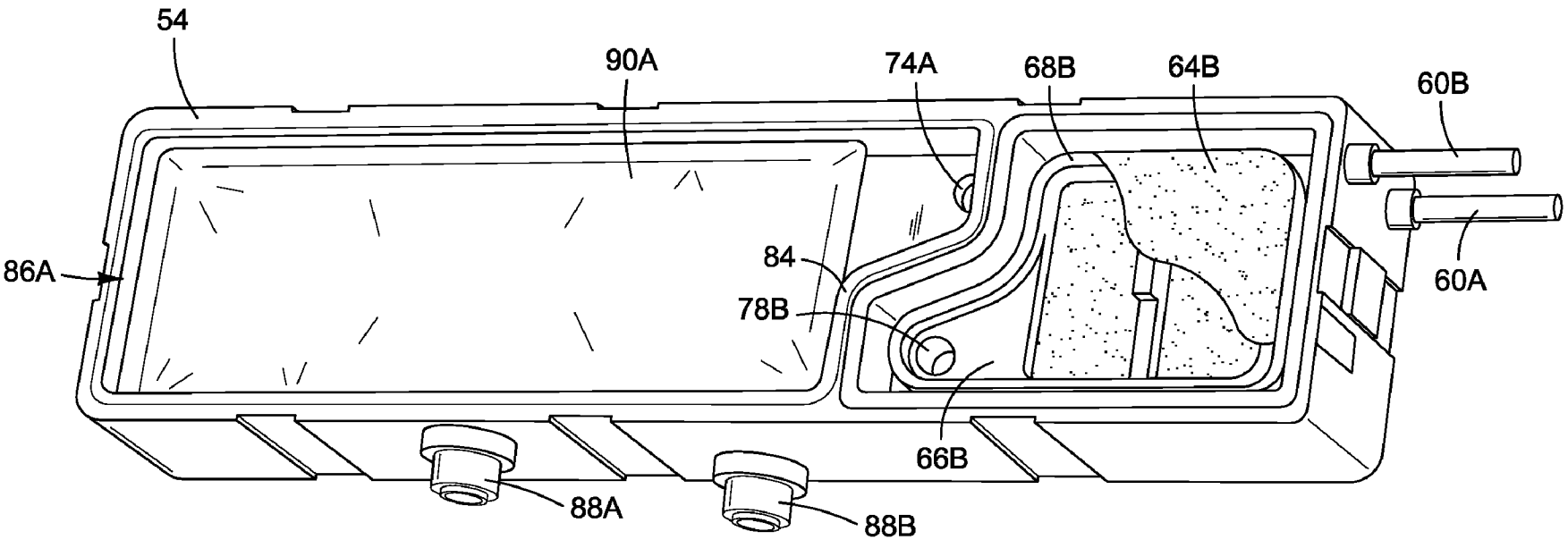
FIG. 5 is a perspective view of the pen body in the ink pen of FIGS. 3 and 4.
Figure 7:
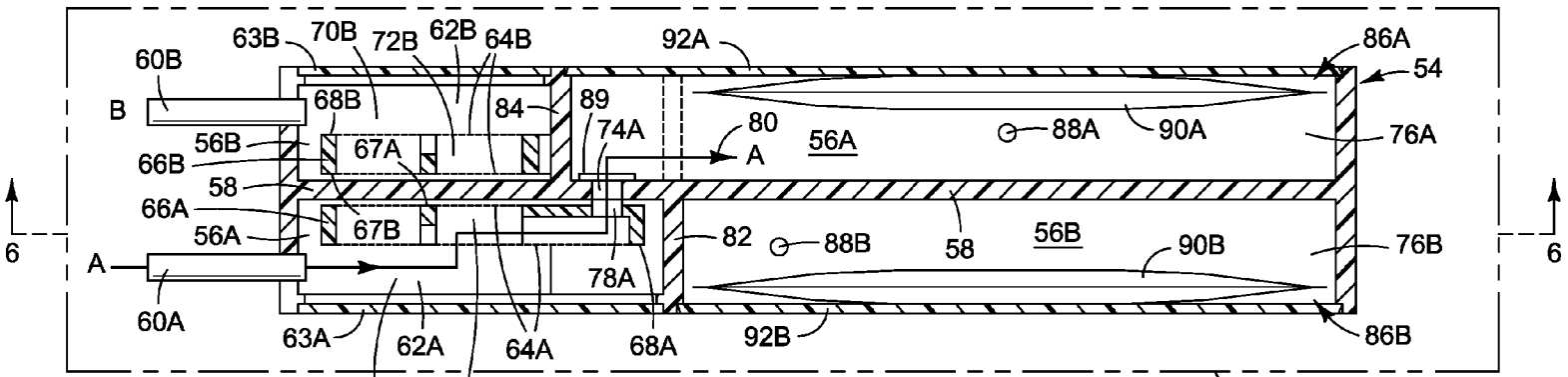
FIG. 7 is a plan section view of the pen body of the ink pen shown in FIGS. 3 and 4 taken along the line 7-7 in FIG. 6.
Figure 6:
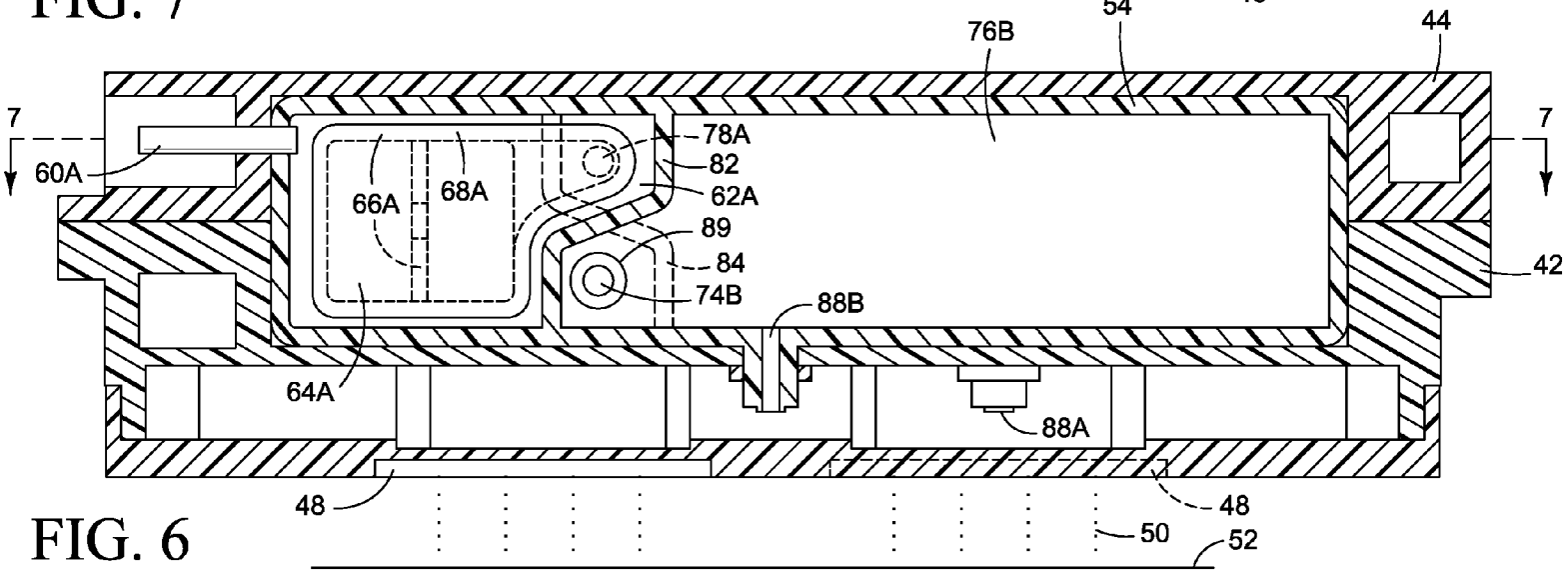
FIG. 6 is an elevation section view of the ink pen shown in FIGS. 3 and 4 taken along the line 6-6 in FIG. 7.

FIGS. 3-7 illustrate one exemplary embodiment of an ink pen 40 that may be used as a pen 26 shown in the block diagrams of FIGS. 1 and 2. FIG. 3 is an elevation view of the exterior of pen 40. FIG. 4 is an exploded perspective view of ink pen 40. FIG. 5 is a perspective view showing the internal design of the pen body and FIGS. 6 and 7 are elevation and plan section views, respectively, of ink pen 40. Referring first to FIGS. 3-4 and 6, pen 40 includes a lower exterior housing 42, an upper exterior housing 44, and a cover or cap 46. The printheads (not shown) are housed in lower housing 42 so that printhead nozzle plates 48 (FIG. 6) are exposed along the bottom of pen 40 for ejecting ink drops 50 (FIG. 6) on to paper or other print media 52 (FIG. 6). The body 54 of pen 40 is housed within upper and lower housings 42 and 44, as best seen in the section view of FIG. 6.

Referring now to FIGS. 4-7, the exemplary embodiment of ink pen 40 shown is configured to receive and eject two different inks. Pen body 54 is divided lengthwise into units 56A and 56B by a central barrier 58. The exploded perspective of pen 40 in FIG. 4 is viewed looking into the inlet side of pen body unit 56A (which is the outlet side of unit 56B) while the detail perspective of pen body 54 in FIG. 5 is viewed looking into the inlet side of pen body unit 56B (which is the outlet side of unit 56A). Ink flows through each pen body unit 56A and 56B to a separate printhead. When ink pen 40 is installed in a printer, ink inlet ports 60A and 60B are connected to an off axis ink supply and pumping system (not shown in FIGS. 3-7), such as an ink supply 14 and pump 16 illustrated in the block diagram of FIG. 1. Ink is pumped through inlet ports 60A and 60B into corresponding filter chambers 62A and 62B, which are enclosed by a cover plate 63A and 63B (FIG. 4).

A filter 64A, 64B is supported on a filter frame 66A, 66B in each filter chamber 62A, 62B. Each filter frame 66A, 66B is positioned in chamber 62A, 62B with an inboard face 67A, 67B facing central barrier 58 and an outboard face 68A, 68B. Each filter 64A, 64B is supported on both the inboard and outboard faces 67A/68A, 67A/68B of filter frame 66A, 66B. Thus, each filter chamber 62A, 62B is divided into two sub-chambers by filter 64A, 64B—an exterior/upstream sub-chamber 70A, 70B and an interior/downstream sub-chamber 72A, 72B.

Each ink inlet port 60A, 60B opens into the exterior sub-chamber 70A, 70B of filter chamber 62A, 62B. A passage 74A, 74B through barrier 58 to pressure regulator chambers 76A, 76B is located at one corner of each filter chamber 62A, 62B. An opening 78A, 78B in the corner of each filter frame 66A, 66B exposes each passage 74A, 74B to interior filter sub-chambers 72A, 72B. Ink pumped into exterior sub-chambers 70A, 70B through inlet ports 60A, 60B passes through filter 64A, 64B into interior sub-chambers 72A, 72B, and then through openings 78A, 78B and passages 74A, 74B into regulator chambers 76A, 76B. The flow of ink through pen unit 56A from inlet port 60A to regulator chamber 76A is illustrated by arrow 80 in FIG. 7. An interior barrier 82 separates the A unit filter chamber 62A from the B unit regulator chamber 76B. An interior barrier 84 separates the B unit filter chamber 62B from the A unit regulator chamber 76A.

A pressure regulator 86A, 86B in each regulator chamber 76A, 76B controls the flow of ink from filter chamber 62A, 62B into chamber 76A, 76B through passage 74A, 74B, and out of chamber 76A, 76B through outlets 88A, 88B to the corresponding printhead. Each pressure regulator 86A, 86B includes, or is operatively coupled to, a flow control valve 89 (FIGS. 6 and 7) that opens and closes each passage 74A, 74B in response to pressure changes in regulator chamber 76A, 76B. When ink is ejected from pen 40, the ink supply in regulator chamber 76A or 76B (or both) is depleted and the pressure inside chamber 76A, 76B falls. As the chamber pressure falls below a predetermined low pressure threshold, pressure regulator 86A, 86B opens flow control valve 89 (or allows valve 89 to open if valve 89 is biased toward the open position), allowing ink from the pressurized filter chamber 62A, 62B to enter regulator chamber 76A, 76B. When enough ink has entered chamber 76A, 76B to raise the pressure to a predetermined high pressure threshold, pressure regulator 86A, 86B closes flow valve 89 (or allows valve 89 to close if valve 89 is biased toward the closed position) to stop the flow of ink into chamber 76A, 76B. The pressure regulators and flow valves mentioned above are well known to those skilled in the art of inkjet printing and, therefore, are not shown or described in detail. Although each pressure regulator 86A, 86B is depicted generally as including an expandable/collapsible bag 90A, 90B and an expanded rigid cover 92A, 92B, any suitable pressure regulator may be used. For example, and as noted above, the spring bag type pressure regulator used in the ink pens for HP's Edgeline Technology printers may be adapted for use as pressure regulators 86A and 86B in pen 40.

It has been discovered that the size of an off axis ink pen can be substantially reduced by locating a filter chamber upstream from the pressure regulator chamber and moving the ink filter upstream from the pressure regulator, as shown in FIGS. 2 and 3-7. In a conventional pen, in which ink is filtered downstream from the pressure regulator, the pressure available to move ink through the filter is limited to the pressure generated by the pumping action of the ink drop generator in the printhead, typically only 1-2 inches of water. This lower pressure requires a larger filter to allow the desired flow of ink to the printhead. When the ink is filtered upstream from the pressure regulator, as described herein, the ink supply inlet pressure, typically 1-10 psi (28-277 inches of water), may be used to drive ink through the filter. The filter chamber, therefore, is a higher pressure chamber compared to the lower pressure regulator chamber. The much higher filter chamber pressure permits a much smaller filter to allow the desired flow to the printhead.

In the Edgeline Technology pens mentioned above, reconfiguring the pen as described herein reduces the desired filter area from 25 $cm^2$ to about 6.5 $cm^2$ and the total pen volume occupied by the pen through its full range of motion by up to 50% while still maintaining adequate ink flows. For an inlet pressure of 1-10 psi, a 6.5 $cm^2$ filter in a pen such as pen 40 described above has been shown to permit ink flows exceeding 100 cc/minute, a flow rate to filter area ratio of more than 15 (using the units of flow and area noted). By contrast, a conventional Edgeline Technology pen delivers a flow rate to filter area ratio of only about 3, permitting about 75 cc/minute ink flow through a 25 $cm^2$ filter.

Figure 10:
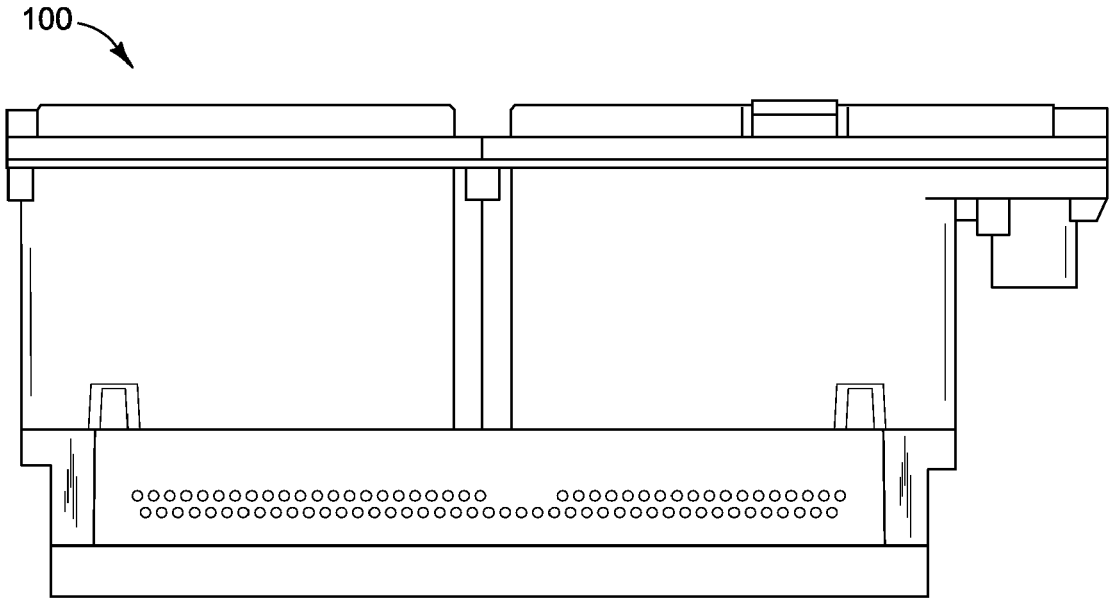
FIG. 10 is an elevation view of a conventional ink pen.
Figure 8:
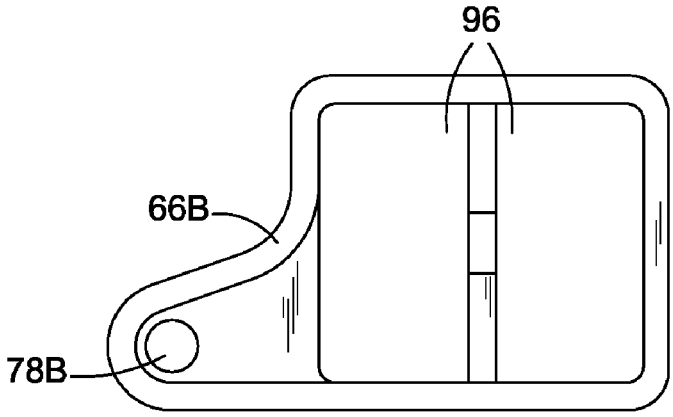
FIG. 8 is an elevation view of one exemplary embodiment of a filter frame.
Figure 9:
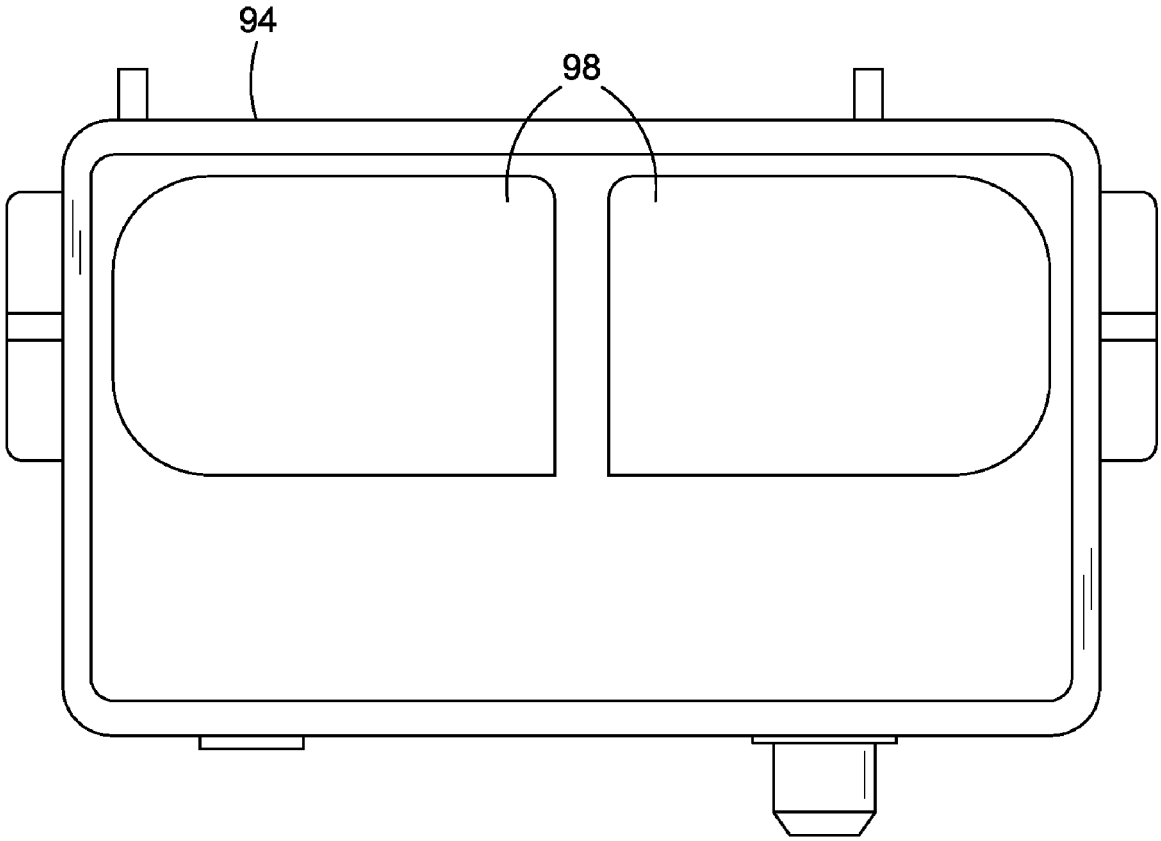
FIG. 9 is an elevation view of a conventional filter frame.

The magnitude of the difference is readily apparent by comparing the filter frames illustrated in FIGS. 8 and 9 and by comparing the ink pens illustrated in FIGS. 3 and 10. Referring first to FIGS. 8 and 9, filter frame 66B is shown in FIG. 8 and a corresponding conventional filter frame, designated part number 94, from an Edgeline Technology ink pen. The size of each filter frame 66B and 94 is proportionate. Not only is the filter/flow area 96 in filter frame 66B much smaller than the filter/flow area 98 in filter frame 94, but the overall size of filter frame 66B is but a small fraction of the overall size of the conventional filter frame 94. The compounding affect of the filter frame size reduction is illustrated in pens 40 and 100 shown proportionately in FIGS. 3 and 10. Referring to FIGS. 3 and 10, a conventional Edgeline Technology ink pen 100 shown in FIG. 10, utilizing filter frames 94 from FIG. 9, is nearly twice the height of, and slightly longer than, an exemplary new ink pen 40 shown in FIG. 3 utilizing the exemplary new filter frames 66A and 66B and the exemplary new flow configuration described above. While the ratio of ink flow rate to filter area will vary depending on the ink volume life of the pen, the pressure available to deliver ink to the pen, the size of the delivery tubes, the density of the filter media, and the cleanliness and viscosity of the ink, it is expected that an ink flow rate to filter area ratio of at least 15 may be achieved in many of the larger, higher performance inkjet pens like those used in the Hewlett-Packard Company Edgeline Technology printers.

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. An ink pen for an inkjet printer, comprising:
an ink filter chamber;
a pressure regulator chamber downstream from the ink filter chamber along a path of ink flow through the pen;
a pressure regulator in the pressure regulator chamber;
a filter in the ink filter chamber;
an inlet to the ink filter chamber upstream from the filter along the ink flow path;
an outlet from the ink filter chamber to the pressure regulator chamber downstream from the filter along the ink flow path such that ink flowing from the inlet to the outlet passes through the filter; and
a flow control valve operative to open and close the outlet in response to pressure changes in the pressure regulator chamber.

2. The ink pen of claim 1, further comprising a printhead operatively connected to the pressure regulator chamber such that ink can flow from the pressure regulator chamber to the printhead.

3. An ink pen for an inkjet printer, comprising:
a first ink holding chamber having a filter therein separating the first ink holding chamber into an upstream sub-chamber and a downstream sub-chamber;
an ink inlet through which ink may flow into the upstream sub-chamber of the first ink holding chamber;
a second ink holding chamber downstream from the first ink holding chamber;
an ink flow passage connecting the downstream sub-chamber of the first ink holding chamber and the second ink holding chamber;
a pressure regulator in the second ink holding chamber;
a flow control valve operative to open and close the ink flow passage in response to pressure changes in the second ink holding chamber; and
a printhead downstream from and operatively connected to the second ink holding chamber.

4. A method implemented in an ink delivery system for an inkjet ink pen, the method comprising:
chambering ink in the pen, wherein the pen comprises:
an ink filter chamber;
a pressure regulator chamber downstream from the ink filter chamber along a path of ink flow through the pen;
a pressure regulator in the pressure regulator chamber;
a filter in the ink filter chamber;
an inlet to the ink filter chamber upstream from the filter along the ink flow path;
an outlet from the ink filter chamber to the pressure regulator chamber downstream from the filter along the ink flow path such that ink flowing from the inlet to the outlet passes through the filter; and
a flow control valve operative to open and close the outlet in response to pressure changes in the pressure regulator chamber;
filtering the chambered ink; and then
regulating the pressure of filtered ink.

5. The method of claim 4, further comprising delivering pressure regulated, filtered ink to a printhead for printing.

6. The method of claim 4, wherein filtering the chambered ink includes filtering the chambered ink in response to regulating the pressure of filtered ink.

7. The method of claim 4, further comprising controlling the flow of filtered ink in response to regulating the pressure of filtered ink.

8. The method of claim 4, wherein chambering ink in the pen comprises chambering ink in the pen at a first pressure and the method further comprises chambering the filtered ink in the pen at a second pressure lower than the first pressure.

9. The method of claim 4, wherein filtering the chambered ink comprises filtering the chambered ink at a rate, measured in cc/minute, at least 15 times greater than an area, measured in cm.sup.2, through which the ink is filtered.

10. A method implemented in an ink delivery system for an inkjet ink pen, the method comprising:
providing the inkjet pen, the inkjet pen comprising:
an ink filter chamber;
a pressure regulator chamber downstream from the ink filter chamber along a path of ink flow through the pen;
a pressure regulator in the pressure regulator chamber;
a filter in the ink filter chamber;
an inlet to the ink filter chamber upstream from the filter along the ink flow path;
an outlet from the ink filter chamber to the pressure regulator chamber downstream from the filter along the ink flow path such that ink flowing from the inlet to the outlet passes through the filter; and
a flow control valve operative to open and close the outlet in response to pressure changes in the pressure regulator chamber;
pumping ink into the ink filter chamber at a first pressure;
filtering ink in the ink filter chamber;
selectively allowing filtered ink to flow from the ink filter chamber into a pressure regulator chamber; and
pumping ink out of the pressure regulator chamber to a printhead at a second pressure lower than the first pressure.

11. The method of claim 10, wherein the first pressure is in the range of 1-10 psi and the second pressure is in the range of 1-2 inches of water.

12. The method of claim 10, wherein the first pressure is in the range of 1-10 psi and filtering ink in the first chamber comprises filtering ink at a rate of flow, measured in cc/minute, at least 15 times greater than an area, measured in cm.sup.2, through which the ink is filtered.

13. An ink pen for separately ejecting two inks, the ink pen comprising:
a first ink filter chamber located on a first side of a barrier that is impervious to ink;
a first filter in the first ink filter chamber;
a second ink filter chamber located on a second side of the barrier opposite the first side of the barrier;
a second filter in the second ink filter chamber;
a first pressure regulator chamber located on the second side of the barrier;
a first pressure regulator in the first pressure regulator chamber;
a second pressure regulator chamber located on the first side of the barrier;
a second pressure regulator in the second pressure regulator chamber;
a first ink inlet through which ink may enter the first ink filter chamber upstream from the first filter;

a second ink inlet through which ink may enter the second ink filter chamber upstream from the second filter;

a first ink flow passage through the barrier connecting the first ink filter chamber with the first pressure regulator chamber, the first ink flow passage located downstream from the first filter;

a second ink flow passage through the barrier connecting the second ink filter chamber with the second pressure regulator chamber, the second ink flow passage located downstream from the second filter;

a first flow control valve operative to open and close the first ink flow passage in response to pressure changes in the first ink regulator chamber;

a second flow control valve operative to open and close the second ink flow passage in response to pressure changes in the second ink regulator chamber;

a first printhead downstream from and operatively connected to the first pressure regulator chamber; and a second printhead downstream from and operatively connected to the second pressure regulator chamber.

14. The ink pen of claim 13, wherein the first ink filter chamber and the second pressure regulator chamber are located longitudinally adjacent to, but fluidically isolated from, one another along the first side of the barrier and the second ink filter chamber and the first pressure regulator chamber are located longitudinally adjacent to, but fluidically isolated from, one another along the second side of the barrier.

15. The ink pen of claim 14, wherein the first ink filter chamber and the second ink filter chamber are located laterally adjacent to one another across the barrier and the first pressure regulator chamber and the second pressure regulator chamber are located laterally adjacent to one another across the barrier.

16. The ink pen of claim 1, wherein the pressure regulator comprises a spring-bag pressure regulator.

17. The ink pen of claim 1, wherein the flow control valve is configured to close the outlet during initial ejection of ink from the ink pen.

18. The ink pen of claim 3, wherein the pressure regulator comprises a spring-bag pressure regulator.

19. The ink pen of claim 3, wherein the flow control valve is configured to close the outlet during initial ejection of ink from the ink pen.

* * * * *

UNITED STATES PATENT AND TRADEMARK OFFICE

CERTIFICATE OF CORRECTION

PATENT NO. : 7,922,312 B2
APPLICATION NO. : 11/739293
DATED : April 12, 2011
INVENTOR(S) : Paul Mark Haines et al.

It is certified that error appears in the above-identified patent and that said Letters Patent is hereby corrected as shown below:

In column 6, line 16, in Claim 9, delete "cm.sup.2," and insert -- $cm^2$, --, therefor.

In column 6, line 49, in Claim 12, delete "cm.sup.2," and insert -- $cm^2$, --, therefor.

Signed and Sealed this
Thirteenth Day of September, 2011

David J. Kappos

David J. Kappos
*Director of the United States Patent and Trademark Office*